United States Patent [19]

Wagner et al.

[11] Patent Number: 4,624,600

[45] Date of Patent: Nov. 25, 1986

[54] ANTI-TERRORIST VEHICLE IMPALER

[76] Inventors: Richard H. Wagner, 1679 Elm St.; George J. Wagner, 5498 Windflower Dr., both of Livermore, Calif. 94550

[21] Appl. No.: 715,072

[22] Filed: Mar. 22, 1985

[51] Int. Cl.[4] ..... E01F 13/00

[52] U.S. Cl. ..... 404/6; 404/9; 49/49; 49/131; 49/33

[58] Field of Search ..... 404/6, 9, 11; 49/49, 49/33, 131; 411/368, 378, 427; 89/1.14; 14/69.5, 71.1, 71.3

[56] References Cited

U.S. PATENT DOCUMENTS

| | | | |
|---|---|---|---|
| 1,845,774 | 2/1932 | Wilson | 404/11 |
| 1,949,295 | 2/1934 | Dean | 404/11 |
| 3,170,365 | 2/1965 | Vaughn | 89/1.14 X |
| 3,352,189 | 11/1967 | Brown | 89/1.14 X |
| 3,475,779 | 11/1969 | Johnson | 14/71.3 |
| 3,698,135 | 10/1972 | Boots et al. | 49/49 X |
| 4,010,505 | 3/1977 | Bouman | 14/71.3 |
| 4,274,172 | 6/1981 | Franklin | 14/69.5 |
| 4,554,695 | 11/1985 | Rowland | 404/11 X |
| 4,577,991 | 3/1986 | Rolow | 404/6 |

FOREIGN PATENT DOCUMENTS

| | | | |
|---|---|---|---|
| 2833353 | 2/1980 | Fed. Rep. of Germany | 49/131 |
| 3134247 | 3/1983 | Fed. Rep. of Germany | 49/49 |

*Primary Examiner*—James A. Leppink
*Assistant Examiner*—Matthew Smith
*Attorney, Agent, or Firm*—Thomas Schneck

[57] ABSTRACT

A vehicle barrier device is installed in a trench in a roadway. An impaler housing sits in a slot of a liner and supports a pivoting member in a slot in its top surface. The pivoting member has an impaling arm on its forward end, a massive counterweight at its rear end, and a pivot between them. One or more pins and an explosive bolt secure the impaling arm to the forward end of the impaler housing. When the device is remotely activated by security personnel, the bolt explodes, freeing the impaling arm. The counterweight is sufficiently massive so that the pivoting member tends to turn about the pivot under the force of gravity, thrusting the impaling arm above the surface of the roadway. The impaling arm projects at an angle toward a vehicle to be stopped, which is impaled by the arms.

17 Claims, 11 Drawing Figures

ANTI-TERRORIST VEHICLE IMPALER

DESCRIPTION

1. Technical Field

The invention relates to traffic barriers for roadways.

2. Background Art

Terrorist attacks on embassies, military bases, and other presences of a foreign government or corporation have become common place. Some of the more notorious attacks have involved terrorists driving trucks carrying explosives through the gates of an embassy and detonating the explosives. In response to these attacks, many embassies now have various types of barriers in front of their gates. Similar cases involving unauthorized entry of military bases have taken place. However, the barriers installed at these installations also obstruct the passage of authorized vehicles.

In U.S. Pat. No. 4,158,514, Dickinson teaches an above grade traffic controller in which a plurality of complementary barrier blades and levers are secured to rotatable sleeves for retraction and extension from a slot in the pavement under the action vehicle tires. The levers depress for vehicles travelling in the right way, but they cause the barrier blades to extend in response to wrong-way vehicle motion, damaging the vehicle's tires.

Damaging a vehicle's tires, while discouraging people from leaving parking lots without first paying, would not stop a terrorist from attacking an installation, because vehicles can travel a considerable distance on damaged tires. Further, the controller is a one-way direction device. Any controller permitting entry of authorized vehicle traffic would also permit terrorist vehicles to entry, and any controller damaging the tires of terrorist vehicles would also damage the tires of authorized vehicles.

In U.S. Pat. No. 4,318,079 to Dickinson, the tire puncturing blades are extendable and retractable with a motor drive. An arm extending horizontally across the roadway and retractable into a vertical position at the side of the roadway is also included The motorized traffic controller does allow passage of authorized vehicles while damaging the tires of other vehicles However, damaged tires would not stop a determined terrorist attack, and the lift-arm can be easily breached. In addition, the controller must be constantly opened and closed to allow vehicle access, which can cause delays and traffic jams in urban areas.

It is an object of the present invention to provide a positive means of stopping unauthorized vehicles from gaining access to a facility.

It is another object of the invention to provide a barrier that allows unobstructed passage of vehicles on authorized business.

It is a further object of the invention to provide reusable barriers that can be instantly activated to stop terrorist vehicles, yet need not be constantly opened to allow authorized vehicles to enter.

DISCLOSURE OF INVENTION

The above objects have been met with a vehicle barrier device having a novel method of stopping a moving vehicle on a roadway. The barrier devices are housed below the surface of a roadway in a trench with the top surface of the barriers level with the surface of the roadway. The barrier has a liner for reinforcing the trench. The liner may be made of precast concrete.

The liner has a lengthwise slot in its top surface in which an impaler housing sits. The housing also has a lengthwise slot in its surface. A pivoting member in the slot of the housing has a central pivot supported by pivot support means on the sides of the housing. The pivoting member also has an impaling arm at its forward end and a massive counterweight at its rear end. The mass of the counterweight is high enough so that, if the pivoting member is unrestrained, the pivoting member tends to turn about the pivot under the force of gravity This turning motion thrusts the impaling arms above the road surface.

Normally, the pivoting member is prevented from turning about the pivot by a pivot restraint means comprising one or more pins and an explosive member joining the impaling arms to the forward end of the impaler housing. An electric switch, radio-controlled triggering mechanism, or some other device is used to explode the member, releasing the impaler arm.

In order to positively stop a terrorist vehicle, one or more barrier devices are installed in the roadway. The number of barriers depends on the width of the roadway and whether backup devices are desired. Security personnel, identifying a vehicle to be stopped, activate the barrier devices. The impaling arms on the barriers are thrust above the surface of the roadway so as to project toward the vehicle to be stopped. The vehicle is stopped when it collides with at least one of the impaling arms, impaling the vehicle.

The barrier devices may be reset by lowering the impaler arms and replacing the pins and explosive member. The impaler housing and pivoting member may be removed with a small crane by using lifting eyes attached to the top of the impaler housing. This facilitates above ground repair or replacement of damaged parts, and cleaning of the trench. A cushioned bushing, generally of soft metal, lines the contact area between the pivot and pivoting member to prevent damage to the pivot and adjacent parts. A hinged cover is usually provided to cover the device, keeping out road debris and water, without affecting its operation. A hose leads from the surface to the bottom of the trench terminating in a sump, for enabling water to be pumped out of the trench.

BEST MODE FOR CARRYING OUT THE INVENTION

Figure 1:
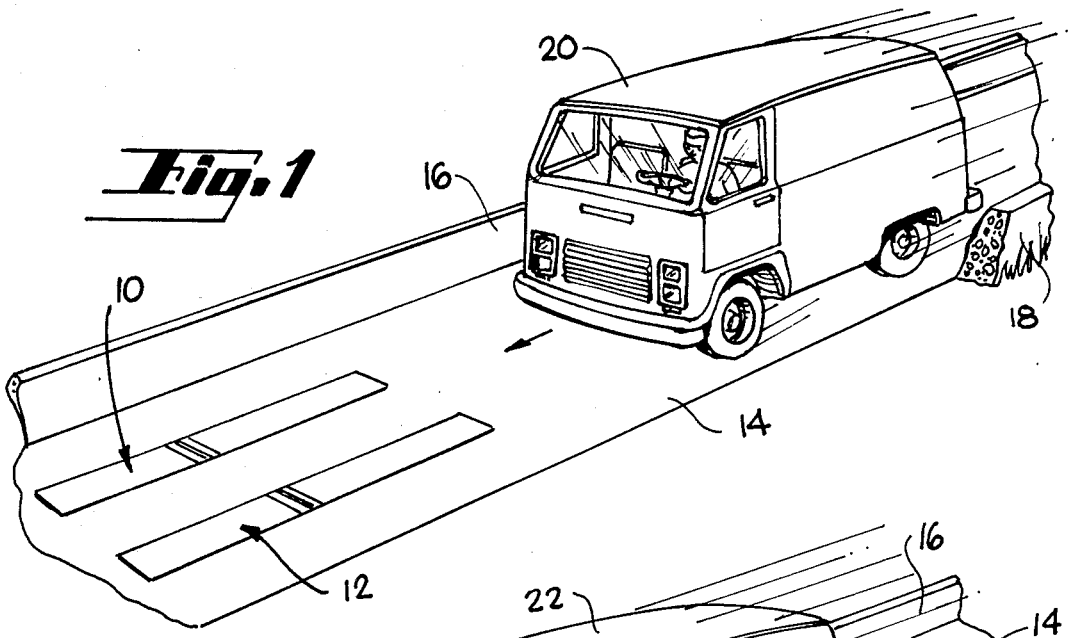
FIG. 1 is a perspective view of a roadway where the present invention has been installed.

With reference to FIG. 1, barrier devices 10 and 12 are installed below ground along a roadway 14 with the top surface of the barrier level with the surface of roadbed 14. Each barrier 10 and 12 is typically about two feet (0.6 m) wide and ten feet (3.0 m) long, although the size is not critical. Several sets of barrier devices can be positioned along a roadway, depending on the width of the roadway 14 and on whether backup barriers are desired. A single barrier could be used, but preferably pairs of spaced apart barriers are employed. The edge-to-edge spacing between barriers is less than the width of a vehicle to be stopped so that a vehicle cannot pass between barriers.

The roadbed 14 may be bounded by parallel opposed walls 16 and 18 or by some similar structure that prevents vehicles from going off the roadway 14 and around the barrier devices 10 and 12. The barriers 10 and 12 may also be placed in the roadway 14 at a gate or other entrance to a walled- or fenced-off facility.

Normally, the top surface of the barriers 10 and 12 is level or generally coplanar with the surface of the roadway. Thus, unobstructed passage of vehicles 20 on authorized business is permitted. Vehicles 20 may pass freely without someone having to open a gate or lift-arm. Drivers might merely have to stop and show their identification to security personnel before continuing on their way.

Figure 2:
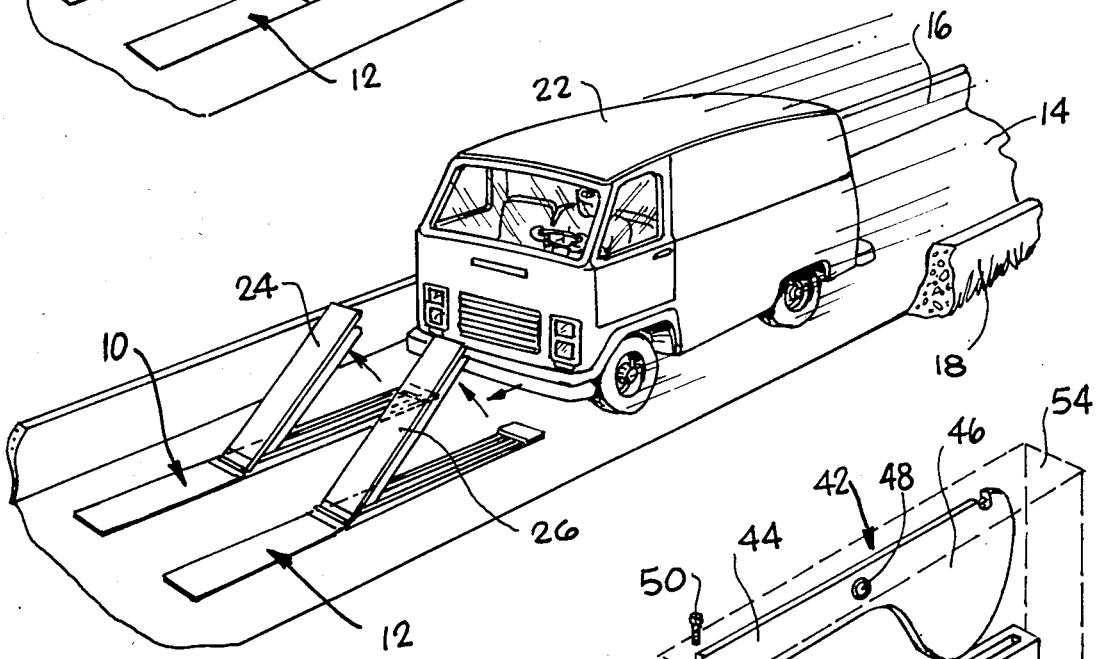
FIG. 2 is a perspective view of a roadway with activated barrier devices

In FIG. 2, an unauthorized vehicle 22 has breached security and is attempting to enter a facility. When the barrier devices 10 and 12 are activated by seourity personnel, one or more impaling arms 24 and 26 are thrust above the surface of the roadway 14 by means of stored potential energy so as to project toward the vehicle 22, providing a positive means of stopping the unauthorized vehicle 22 from gaining access to the facility. The vehicle is prevented from going around the devices 10 and 12 by parallel opposed walls 16 and 18 bounding the access roadbed 14. The vehicle 22 either stops before reaching the barriers 10 and 12 or is impaled by at least one of the impaling arms 24 and 26 of the barriers 10 and 12. In either case, access to the facility is thwarted.

Figure 3:
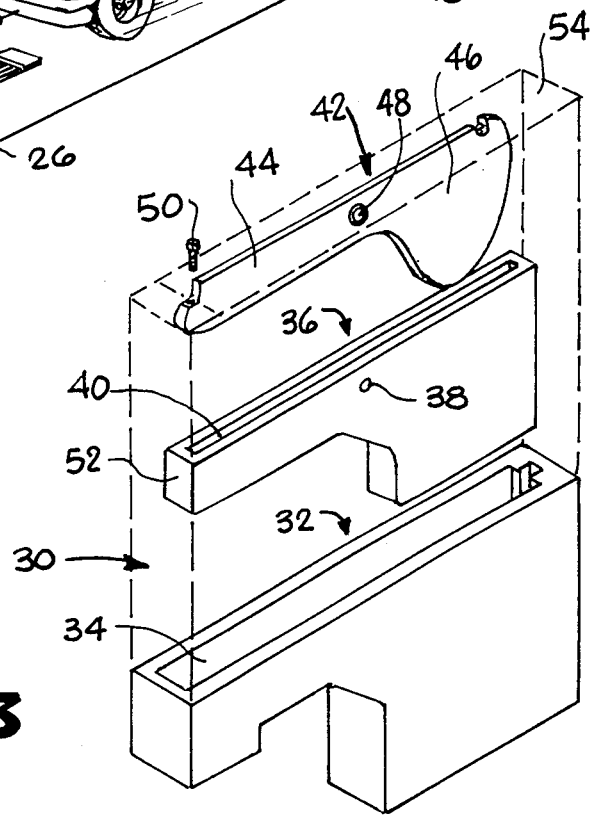
FIG. 3 is an exploded view of the present invention.

In FIG. 3, vehicle barrier device 30 has a liner 32, usually made of precast concrete, for reinforcing a trench cut below a roadbed. The liner 32 has a vertical slot 34 in the top surface of the liner. When the liner 32 is inserted into the roadway, the slot 34 is lined up lengthwise, i.e. in the direction of vehicular movement Generally, the forward end of the liner 32, i.e. the direction from which vehicles come, is shallower than the rear end of the liner, in order to better support the impaler housing 36 and the impaler arm 44 of the pivoting member 42, but this feature is not critical to the device's 30 operation.

The barrier device 30 has an impaler housing 36 which fits into the slot 34 of the liner 32. The housing 36 is generally made of metal, such as steel, but may also be made of other strong materials The housing 36 has a pivot support 38 in its sides for holding a pivot 48, and also has a lengthwise vertical slot 40 in its top surface.

A pivoting member 42 is inserted into the housing slot 40. The pivoting member 42 has an impaler arm 44 at its forward end that, when activated, is thrust above the surface of the roadway so as to project toward approaching vehicles at an angle between 30 and 60 degrees. The arm has a preferred length in the range of 2 to 10 feet, but longer or shorter arms could be used. The pivoting member 42 also has a massive counterweight 46 at its rear end storing potential energy. The mass of the counterweight must be sufficiently high that the pivoting member 42 tends to turn about pivot 48 in the pivot support 38. Pivot 48 is between impaler arm 44 and counterweight 46, and the pivoting member 42 is typically one integral piece. The tendency to turn is such that counterweight 46 is forced downward by gravity and the impaler arm 44 is forced upward by movement of the counterweight 46.

A pin 50 passes through the impaler arm 44 and the forward end of the impaler housing 36 and is con-nected to an explosive bolt. The pin 50 acts as a pivot restraint, preventing the turning of the pivoting member 42 until the device 30 is activated, releasing potential energy stored in the counterweight. Potential energy could also be stored in a spring so that a counterweight would not be needed. The spring would be mounted below the impaler arm and cause the arm to pop up on command.

Figure 4:
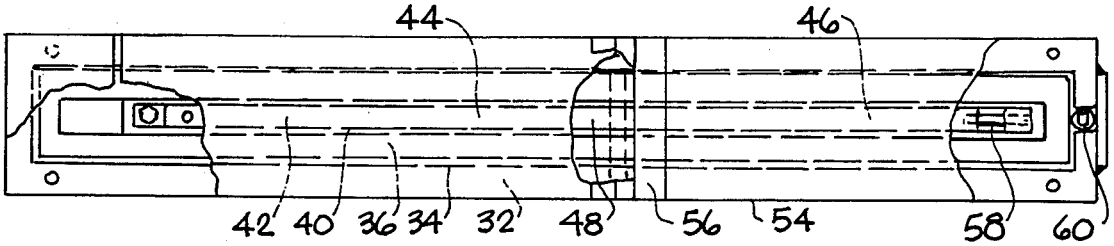
FIG. 4 is a top plan view of the present invention.

A hinged road cover 54 covers the entire assembled unit 30 and protects it from weather and road debris. In FIG. 4, road cover 54 has a hinge 56 nearly above the pivot 48. This allows the forward part of the cover 54 to swing upwards with the impaler arm 44 when the device is activated. The forward part of the cover may be integrally connected to the impaler arm 44.

Pivoting member 42 and impaler housing 36 do not fit snuggly into their respective slots 40 and 34, but rather are spaced slightly from the adjacent members 36 and 32. Thus, pivoting member 42 fits into housing slot 40 with some space from impaler housing 36. In this way the pivoting member 42 is free to turn frictionlessly about pivot 48 when it is activated. Similarly, impaler housing 36 fits into liner slot 34 with some space from liner element 32, so that it can easily be installed or removed without binding to the liner 32.

Figure 5:
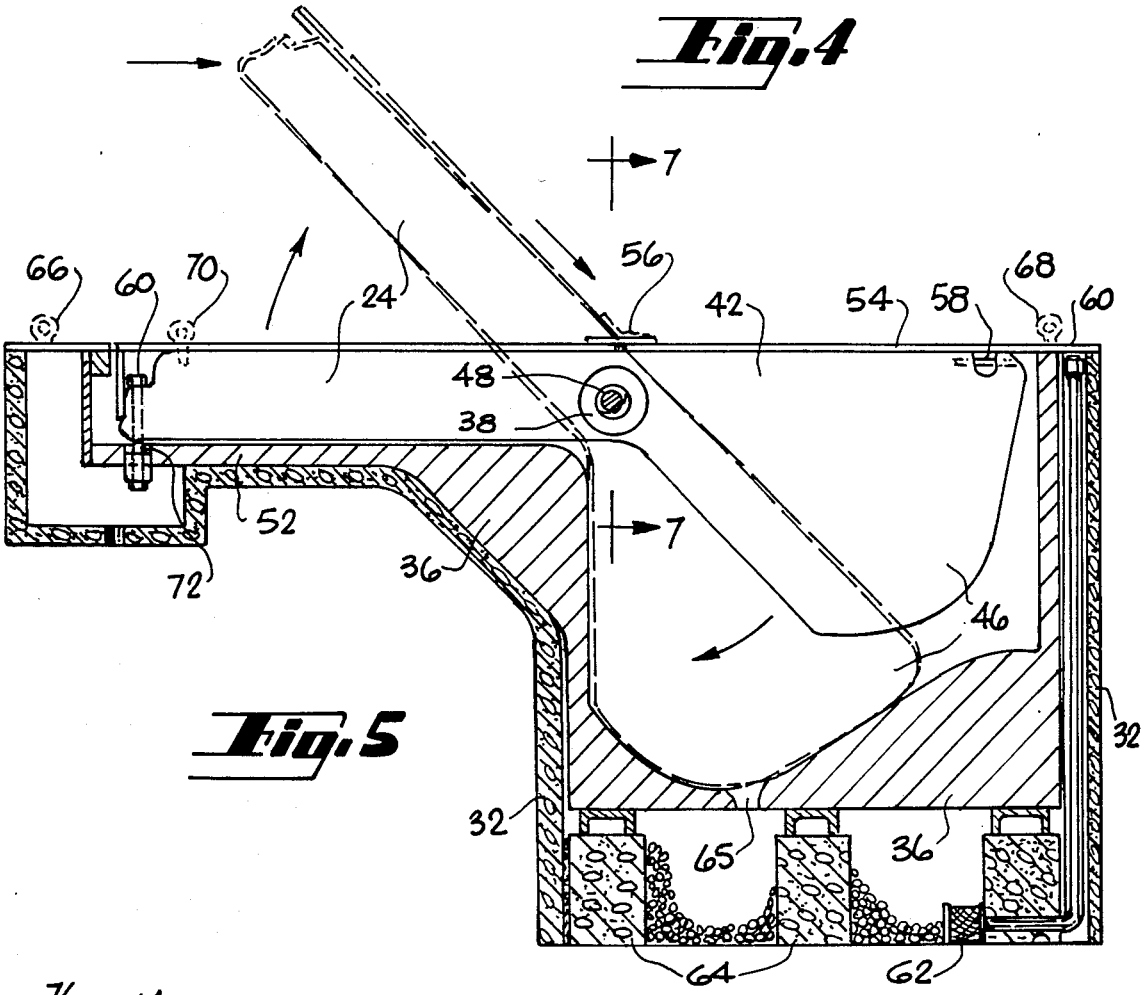
FIG. 5 is a side cutaway view of the present invention.

The counterweight 46 of the pivoting member 42 can be fitted with a bumper 58 on its upper surface so that when an activated device is retracted to the inactivated position, the cover 54 will not be damaged. A hose 60 may be used to pump out rainwater that has accumulated at the bottom of the concrete liner 32. Hose 60 can be seen better in FIG. 5 leading down to the bottom of liner 32 and terminating in a sump 62. Impaler housing 36 rests on concrete blocks 64 or similar supports within the liner 32. A drain hole 65 in the bottom of impaler housing 36 allows water to drain into the bottom of liner 32, where it may be pumped out through hose 60.

Lifting eyes 66 and 68 on the impaler housing 36 make service of each unit possible. Alternatively, eye 70 on the impaling arm 24 can be used in place of eye 66. A portable crane cable can be attached to lifting eyes 66 and 68 and the impaler housing 36 with pivoting member 42 lifted out of the liner 32. With the housing 36 removed, the pit is accessible to crews for cleaning liner 32. Replacement or repair of the impaler housing 6 on the pivoting member 42 can be made above ground. Lifting eyes 66 and 68 also make the unit portable and thus readily available for use at all types of installations.

The pivoting member 42 has an impaling arm 24 and a counterweight 46 on opposite sides of a pivot 48. Pivot 48 sits in pivot support 38 of impaler housing 36 and allows the pivoting member 42 to turn about it. Counterweight 46 is of sufficient mass relative to impaling arm 24 that the pivoting member 42 tends to turn when it is not restrained.

In the inactivated position, the impaling arm 24 and counterweight 46 are level with the roadway, i.e., with top surface of the device. The hinged roadway cover 54 lies flat. The pivoting member 42 is restrained from turning by a pin 60 and explosive member 72. Pin 60 passes through impaling arm 24 and secures it with member 72 to the forward end 54 of the impaler housing 36.

In operation, an electric or radio trigger, operated by security personnel, causes explosive member 72 to explode. Pin 60 no longer secures the impaling arm 24 to the forward end 54 of the impaler housing 36. Gravity forces counterweight 46 downward, causing the entire pivoting member 42 to turn about pivot 48. Impaling arm 24 is thrust upwards above the surface of the roadway.

In the activated position, the impaling arm 24 projects forward at an angle to the roadway. The forward part of the hinged cover 54 also projects at the same angle as the impaling arm 24, either resting on or secured to the impaling arm 24. The rear portion of cover 54 still lies flat with the roadway. Hinge 56 on the cover 54 allows the cover to bend. Counterweight 46 is positioned at the bottom of impaler housing 36 and is $ restrained from further movement by the bottom and sides of the impaler housing 36.

Figure 6:
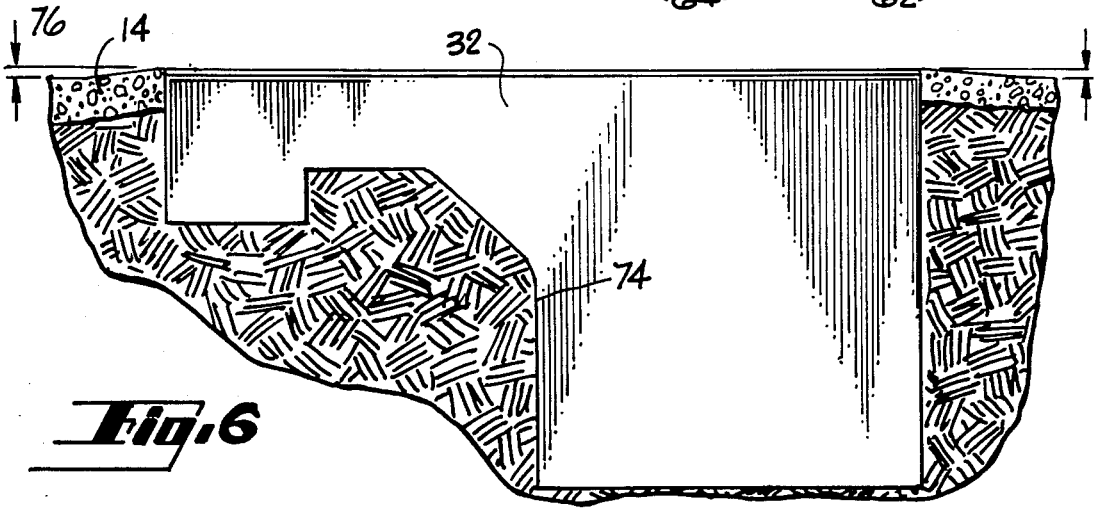
FIG. 6 is a side cutaway view of the liner of the present invention.

Barrier devices are housed below ground, recessed within the roadbeds to and from a facility. In FIG. 6, a concrete or similar liner 32 is positioned in an earthen trench 74 in roadway 14. Liner 32 lines the trench 74 from the road surface downwards and is used to reinforce the trench 74. Generally, the liner 32 is precast in the desired shape. The trench 74 can be easily made with a backhoe or similar excavating machine. Small deviations 76 in the depth of the trench 74 from the depth of the liner 32 can be corrected by adjusting the level of the roadway 14.

Figure 7:
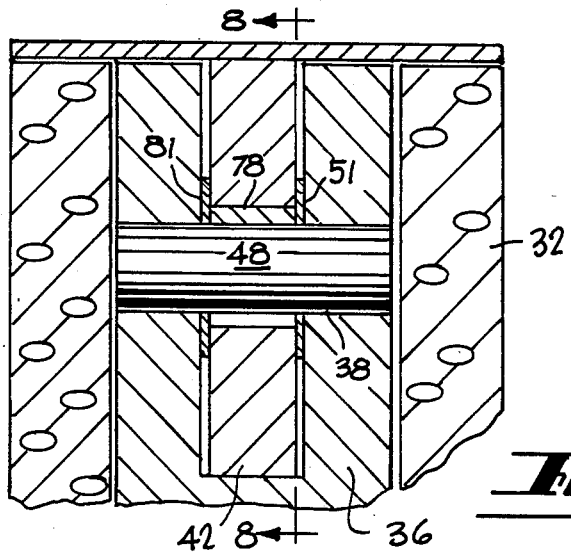
FIG. 7 is a sectional view taken along the liner 7—7 in FIG. 4.
Figure 8:
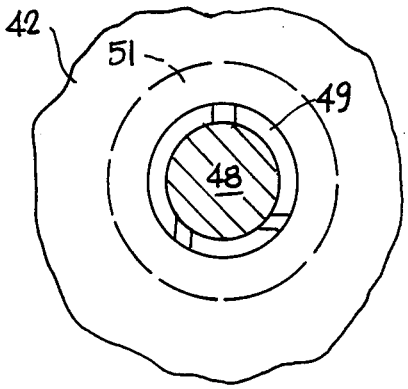
FIG. 8 is a sectional view taken along the liner 8—8 in FIG. 7.

In FIGS. 7 and 8, pivoting member 42 turns about a pivot 48. Pivot 48 is supported in impaler housing 36 by pivot support 38. Typically, the pivot is a metal cylinder four to six inches (10 to 15 cm) in diameter and about one foot long. The pivot does not extend through the liner 32, but stops at the outside edge of the impaler housing 32. A cushioned bushing 49, made of a soft metal or similar cushioning material, lines the contact area between pivot 48 and pivoting member 42. The bushing 78 allows the pivoting member 42 to turn about 48 without binding. The bushing 49 has flanged members 51 and 81 extending from the pivot 48 between pivoting member 42 and impaler housing 36. Flanged members 51 and 81 guide the pivoting member 42, keeping it from binding with the impaler housing 36. The bushing 78 is made of a cushioning material, such as soft metal, to prevent damage to the pivot 48 and pivoting member 42 when a vehicle impacts the impaling arm of the pivoting member 42.

Figure 9:
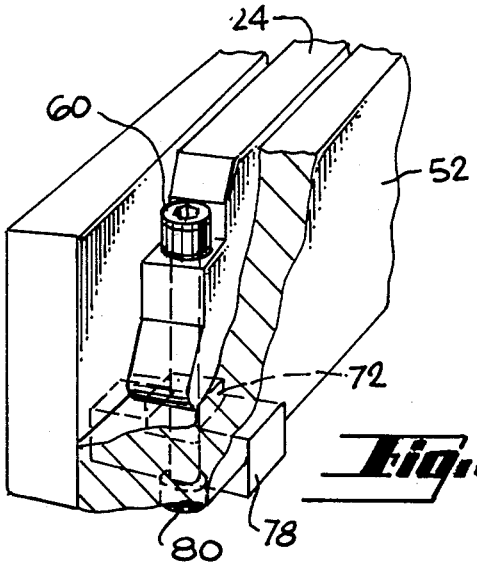
FIG. 9 is a perspective cutaway view of the forward end of the present invention.
Figure 10:
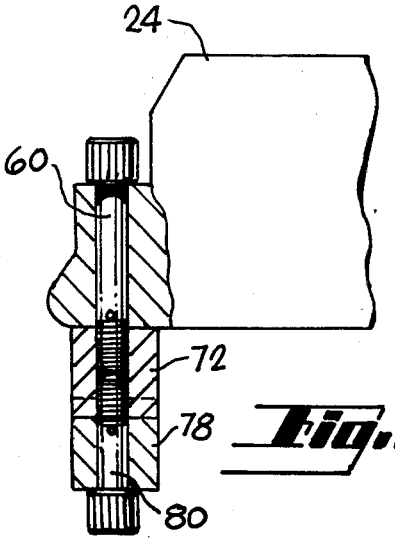
FIG. 10 is a side cutaway view of the forward end of the present invention.

In FIGS. 9 and 10, an impaling arm 24 is held in place to the forward end 52 of the impaler housing by an explosive member 72. A pin 60 passes through the end of impaling arm 24 and screws onto member 72. A block 78 is on the underside of the end of the impaler housing 52. A second pin 80 passes through block 78 and screws onto member 72. In this way, no motorized, hydraulic, power pump or electronic components are needed to activate the barrier other than power for the explosive trigering device. Alternatively, a single pin 60 may pass through both the impaling arm 24 and the impaler housing 52 where it is bolted on the underside of the housing 52.

The explosive member 72 is made of any known explosive material that can be formed into a reasonably strong joining member. The explosive member must not explode prematurely in extreme temperatures. The explosive member should be strong enough not to crack when driven over by heavy trucks or other vehicles common to military installations. The explosive member should not explode with so much force as to damage the barrier, but only so as to quickly disintegrate itself, allowing the counterweight to fall.

The explosive 72 is remotely activated by an electric switch, radio-controlled firing device, or some different type of firing mechanism. A manual triggering device may be used to back up the explosive devices.

Figure 11:
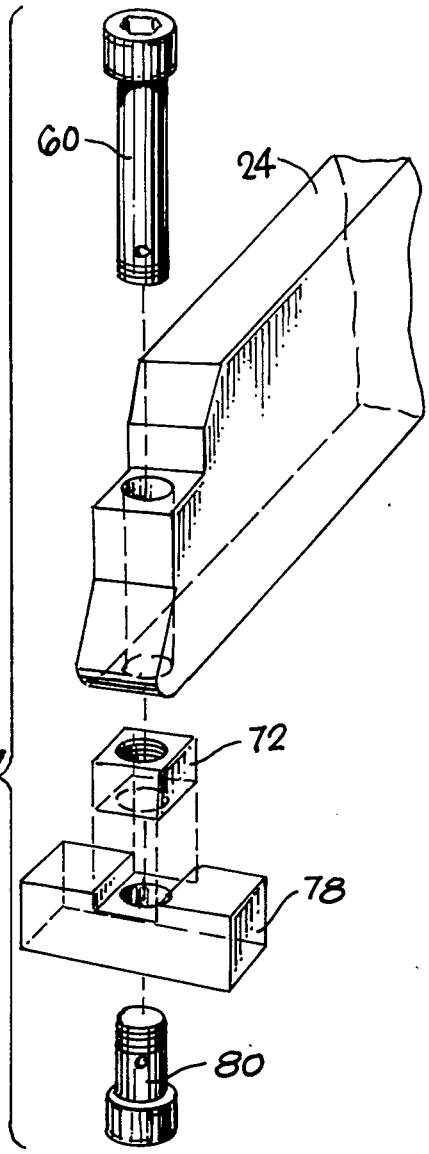
FIG. 11 is an exploded view of the forward end of the present invention.

In FIG. 11, the impaler arm restraint is most easily assembled by slipping pin 80 through block 78, placing block 78 in position under the end of the impaler housing 52 and screwing the explosive member 72 onto the end of pin 80. Impaler arm 24 is then lowered into a position nearly level with the roadway. Slipping pin 60 through the end of the impaler arm 24, pin 60 is screwed onto the explosive member. The barrier is then ready for use.

We claim:

1. A vehicle barrier comprising:

a pivotally mounted, counterbalanced impaler arm for burial in a section of roadbed carrying vehicular traffic, the arm having an upper surface, and having a free end, an intermediate pivot and a pivot end, the roadbed having a surface with the upper surface of the arm substantially coplanar with the roadbed surface, said pivot end having a massive counterweight opposite said free end, means for storing gravitational potential energy associated with said counterweight below the roadbed when said arm is in said substantially coplanar position with the roadbed, said stored gravitational potential energy capable of being communicated to the free end of said impaler arm by causing said arm to rotate about the pivot, with the free end of said arm projecting upwardly from the roadbed at an angle facing said vehicular traffic, and means for explosively releasing said potential energy on command.

2. The barrier of claim 1 wherein said arm has a restraint means for preventing pivoting of the arm.

3. The barrier of claim 1 wherein the length of the arm is in the range of 2 to 10 feet.

4. The barrier of claim 1 wherein said impaler arm is supported in an impaler housing, said housing for burial in said section of roadbed.

5. The barrier of claim 4 wherein a support for said arm in said housing comprises a bushing which is relatively soft compared to said pivot rotatably mounted therein.

6. The barrier of claim 4 wherein said impaler housing is mounted in a liner which is seated in earth below said roadbed.

7. The barrier of claim 1 further defined by a plurality of spaced apart arms laterally separated by a distance less than the width of a vehicle to be stopped.

8. A vehicle barrier device comprising, an impaler housing having a lengthwise slot in a top surface of the housing, and a pivot support means inside of the housing, a pivoting member in the slot of said housing, said pivoting member having an impaling arm at its forward end, a massive counterweight at its rear end, and a pivot between said impaling arm and said counterweight, the pivot being supported by said pivot support means, the mass of the counterweight being high enough that said pivoting member tends to turn about said pivot, with the free end of the arm projecting upward at an angle relative to the top surface of the housing whereby a vehicle attempting to pass over the housing would be impaled by said arm, a pivot restraint means for preventing the turning of said pivoting member about said pivot, and an explosive activating means for removing said pivot restraint.

9. The device of claim 8 wherein said pivot restraint means comprises, a first pin inserted through said impaling arm, a second pin inserted through said impaler housing, and an explosive member joining both said first pin and said second pin.

10. The device of claim 8 wherein said pivot restraint means comprises, a pin inserted through said implaing arm and said impaler housing, and an explosive member joining said pin on the underside of said impaler housing.

11. The device of claim 8 wherein said activating means is an electric switch coupled to said explosive bolt.

12. The device of claim 8 further comprising a liner for reinforcing a trench in a roadway, said liner having a length with a forward end and a rear end, said liner having a lengthwise slot in a top surface of the liner.

13. The device of claim 12 further comprising a hinged cover lying over said liner, said impaler housing and said pivoting member, said hinged cover having a hinge generally spaced above said pivot.

14. The device of claim 12 wherein a bushing lines the contact area between said pivot and said pivoting member, said bushing being made of a soft material relative to the pivot.

15. The device of claim 14 wherein said bushing has flanged members extending radially from said pivot between said pivoting member and said impaler housing.

16. The device of claim 8 wherein said impaler housing is spaced from a bottom of said liner.

17. The device of claim 16 further comprising a hose leading from the top surface of the liner to the bottom of the liner between said liner and said impaler housing, said hose terminating at the bottom in a sump.

* * * * *

UNITED STATES PATENT AND TRADEMARK OFFICE

CERTIFICATE OF CORRECTION

PATENT NO. : 4,624,600

DATED : November 25, 1986

INVENTOR(S) : Richard H. Wagner et al.

It is certified that error appears in the above—identified patent and that said Letters Patent is hereby corrected as shown below:

Column 1, line 46, after "vehicles" insert a period.

Column 2, line 12, after "gravity" insert a period.

Column 3, line 33, "activated by seourity" should read - -activated by security- -.

Column 3, line 50, after "movement" insert a period.

Column 3, line 60, after "materials" insert a period.

Column 4, line 13, "con-nected" should be - -connected- -.

Column 4, line 58, "impaler housing 6" should read - -impaler housing 36- -.

Column 5, at the end of line 24 the $ sign should be removed.

Signed and Sealed this

Twenty-fourth Day of February, 1987

*Attest:*

DONALD J. QUIGG

*Attesting Officer* *Commissioner of Patents and Trademarks*